US005687883A

United States Patent [19]

Su

[11] Patent Number: 5,687,883

[45] Date of Patent: Nov. 18, 1997

[54] INDUCTOR VALVE OF AN ATOMIZER

[76] Inventor: Cheng-Yuan Su, P.O. Box 438, Hsinchu City, Taiwan

[21] Appl. No.: 559,064

[22] Filed: Nov. 16, 1995

[51] Int. Cl.[6] ..... B65D 88/54

[52] U.S. Cl. ..... 222/321.2

[58] Field of Search ..... 222/321.2, 321.7, 222/321.9, 383.1, 382

[56] References Cited

U.S. PATENT DOCUMENTS

| | | | |
|---|---|---|---|
| 4,025,046 | 5/1977 | Boris . | |
| 4,277,001 | 7/1981 | Nozawa . | |
| 4,305,530 | 12/1981 | Nozawa . | |
| 4,369,900 | 1/1983 | Saito et al. . | |
| 4,462,549 | 7/1984 | Saito et al. . | |
| 4,606,479 | 8/1986 | Van Brocklin . | |
| 4,821,928 | 4/1989 | Su . | |
| 4,930,999 | 6/1990 | Brunet et al. . | |
| 5,105,994 | 4/1992 | Jouillat et al. | 222/321.2 |
| 5,370,280 | 12/1994 | Su . | |

FOREIGN PATENT DOCUMENTS

| | | |
|---|---|---|
| 2 314 772 | 1/1977 | France . |
| 2 512 517 | 3/1983 | France . |
| 2 004 585 | 4/1979 | United Kingdom . |

*Primary Examiner*—Philippe Derakshani
*Attorney, Agent, or Firm*—Bacon & Thomas

[57] ABSTRACT

An inductor valve is installed in the accumulation chamber of an atomizer for controlling the water passage thereof, the inductor valve having a hollow cylindrical valve body at one end, a downward guide rod suspended from the inside of the hollow cylindrical valve body at the center, a valve rod at an opposite end, collar disposed between the hollow cylindrical valve body and the valve rod, an extension rod longitudinally extended from the valve rod at one end remote from the valve body and terminating in a cylindrical tip for stopping the water passage of the atomizer, wherein the valve rod and the extension rod define a step having a plurality of radial water grooves extending radially from the root of the extension rod, the radial water grooves including a plurality of close-end grooves and open-end grooves radially alternatively extended from the root of the extension rod, the close-end grooves and the open-end grooves being disposed in communication with one another around the root of the extension rod.

1 Claim, 2 Drawing Sheets

INDUCTOR VALVE OF AN ATOMIZER

BACKGROUND OF THE INVENTION

The present invention relates to atomizers, and relates more particularly to an improved induction valve structure for an atomizer.

Chinese utility model no. 90203532.0, which is an invention of the present inventor, discloses an inductor valve which greatly improves the atomizing effect of the atomizer. This structure of inductor valve is installed in the accumulation chamber of the atomizer for controlling the water passage thereof. This inductor valve comprises a hollow cylindrical valve body at one end, a downward guide rod suspended from the inside of the hollow cylindrical valve body at the center, a valve rod at an opposite end, a collar disposed between the hollow cylindrical valve body and the valve rod, an extension rod extending longitudinally from the valve rod at one end remote from the valve body and terminating in a cylindrical tip for stopping the water passage of the atomizer.

SUMMARY OF THE INVENTION

The present invention is an improvement made on the aforesaid inductor valve. According to the present invention, the valve rod and the extension rod define a step having a plurality of radial water grooves extending radially from the root of the extension rod, the radial water grooves including a plurality of close-end grooves and open-end grooves radially and alternatively extending from the root of the extension rod, the close-end grooves and the open-end grooves being disposed in communication with one another around the root of the extension rod.

DETAILED DESCRIPTION OF THE PREFERRED EMBODIMENT

Figure 1:
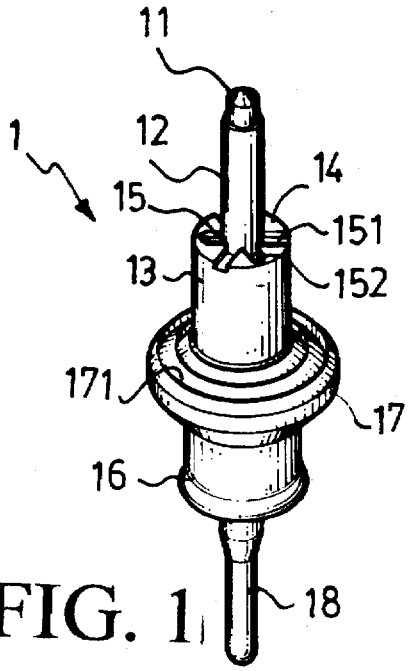
FIG. 1 is a perspective view of an inductor valve according to the present invention.

Referring to FIG. 1, the inductor valve, referenced by 1, comprises a hollow cylindrical valve body 16 at one end, a downward extending guide rod 18 suspended from the inside of the valve body 16 at the center, a valve rod 13 at an opposite end, a collar 17 disposed between the valve body 16 and the valve rod 13, an extension rod 12 extending longitudinally from the valve rod 13 at one end remote from the valve body 16 and terminating in a cylindrical tip 11. The outer diameter of the cylindrical tip 11 is smaller than that of the extension rod 12. The outer diameter of the extension rod 12 is smaller than that of the valve body 16. The valve rod 13 and the extension rod 12 define a step 14 having a plurality of radial water grooves 15. The radial water grooves 15 include a plurality of close-end grooves 151 and open-end grooves 152 radially and alternatively extending from the root of the extension rod 12. Therefore, the close-end grooves 151 and the open-end grooves 152 are disposed in communication with one another around the root of the extension rod 12. The collar 17 comprises a plurality of annular grooves 171 concentrically disposed at one side around the root of the valve rod 13.

Figure 2:
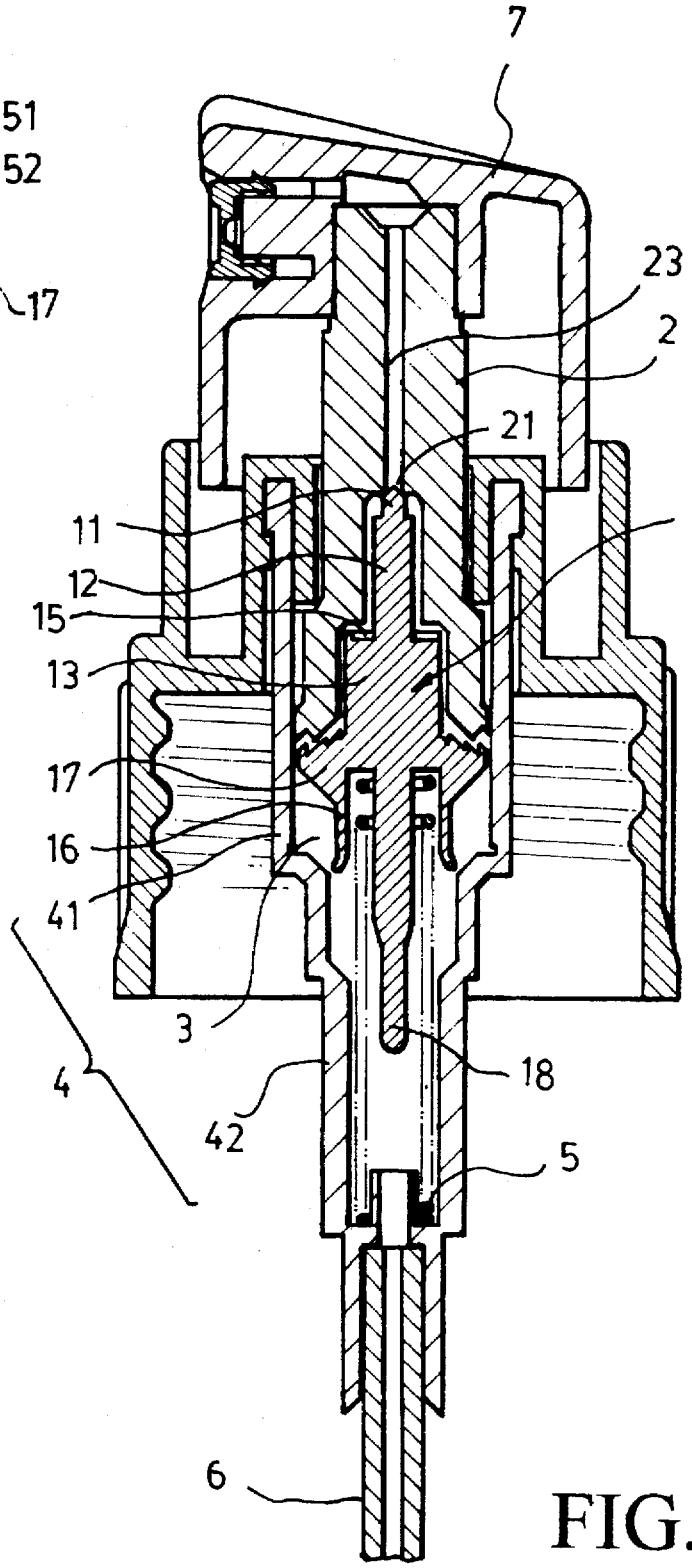
FIG. 2 is a sectional view showing the inductor valve of FIG. 1 installed in the atomizer.

FIG. 2 shows the inductor valve 1 installed in the atomizer. As illustrated, the inductor valve 1 is installed in the accumulation chamber 3 of the upper part 41 of the accumulator 4, and inserted into the piston 2 below the press head 7. When installed, the downward guide rod 18 of the inductor valve 1 is inserted into a coiled spring 5, which is mounted inside the lower part 42 of the accumulator 4 above the dip tube 6, and the cylindrical tip 11 is stopped at the entrance 21 of the longitudinal water passage 23 of the piston 2.

Figure 3:
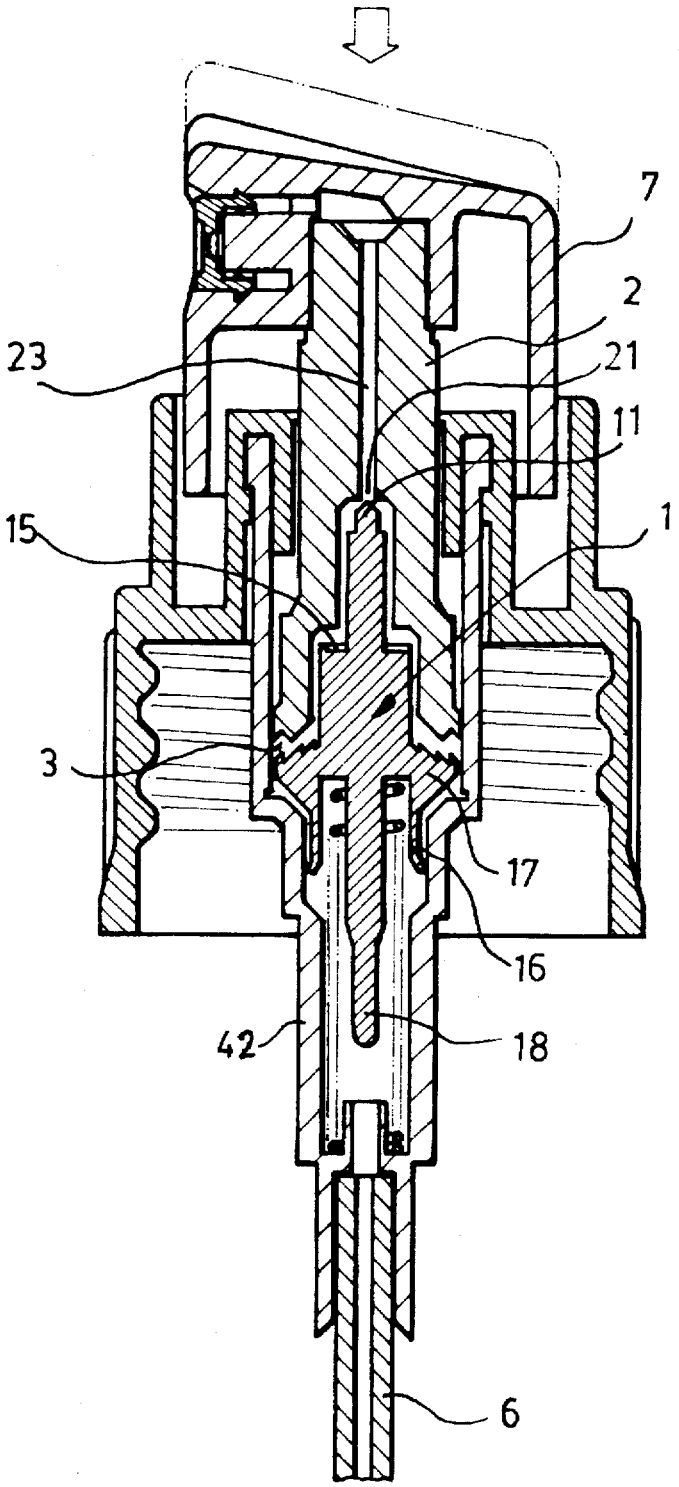
FIG. 3 is similar to FIG. 2 but showing the atomizer being operated.

Referring to FIG. 3, when the press head 7 is depressed, the piston 2 and the inductor valve 1 are moved downwardly. When the piston 2 is continuously moved downwardly, liquid in accumulation chamber 3 is squeezed and forced upwardly through the entrance 21 into the longitudinal water passage 23 and then continuously forced out of the press head 7.

Referring to FIG. 3 again, when the inductor valve 1 is moved downwardly by the piston 2, the valve body 16 fits into the lower part 42 of the accumulator 4 to seal the accumulation chamber 2. When the press head 7 is continuously depressed and released, the pressure of the accumulation chamber 2 is correspondingly increased and acts on the step 14 and the collar 17, causing the inductor valve 1 to move downwardly and compress the coiled spring 5. When the inductor valve 1 is rapidly forced downwardly, compressed liquid is forced upwardly to flow through the entrance 21 into the longitudinal water passage 23 and then to flow out of the press head 7 into fine drops. The water grooves 15 of the step 14 guides liquid into the accumulation chamber 3 during the up stroke of the press head 7, and bear compression force during the down stroke of the press head 7 for permitting the compression force to effectively act against the spring force of the coiled spring 5, and therefore the inductor valve 1 can be efficiently forced downwardly to compress the coiled spring 5 during the down stroke of the press head 7.

I claim:

1. An inductor valve for installation in an accumulation chamber of an atomizer for controlling the passage of water therethrough, the inductor valve comprising a hollow cylindrical valve body at a first end, a guide rod suspended downwardly from the inside of said hollow cylindrical valve body at the center thereof, a valve rod at a second opposite end, a collar disposed between said hollow cylindrical valve body and said valve rod, an extension rod extending longitudinally from said valve rod and terminating in a cylindrical tip for stopping the water passage of the atomizer, said valve rod and said extension rod defining a step having a plurality of radial water grooves extending radially from a root of said extension rod, said radial water grooves including a plurality of close-end grooves and a plurality of open-end grooves radially and alternatively extending from the root of said extension rod, and said close-end grooves and said open-end grooves being disposed in communication with one another around the root of said extension rod.

* * * * *